US012352141B2

(12) United States Patent
Rimmer

(10) Patent No.: US 12,352,141 B2
(45) Date of Patent: Jul. 8, 2025

(54) JOURNAL BEARING LUBRICATION SIDE PORTS FOR OPTIMUM BEARING LOAD CAPACITY

(71) Applicant: Halliburton Energy Services, Inc., Houston, TX (US)

(72) Inventor: Michael Rimmer, Frimley (GB)

(73) Assignee: Halliburton Energy Services, Inc., Houston, TX (US)

( * ) Notice: Subject to any disclaimer, the term of this patent is extended or adjusted under 35 U.S.C. 154(b) by 274 days.

(21) Appl. No.: 17/975,073

(22) Filed: Oct. 27, 2022

(65) Prior Publication Data

US 2024/0141764 A1 May 2, 2024

(51) Int. Cl.
*E21B 43/12* (2006.01)
*F04D 13/10* (2006.01)
*F04D 29/047* (2006.01)

(52) U.S. Cl.
CPC ..... *E21B 43/128* (2013.01); *F04D 13/10* (2013.01); *F04D 29/047* (2013.01)

(58) Field of Classification Search
CPC ..... F04D 13/10; F04D 29/047; F04D 29/046; F04D 29/0462; F04D 29/0476; F04D 29/0473; F04D 25/0686; F04D 13/086; F04D 29/588; F04D 29/061
See application file for complete search history.

(56) References Cited

U.S. PATENT DOCUMENTS 5,209,577 A * 5/1993 Swatek ..... F04D 13/10 384/220
6,566,774 B2 * 5/2003 Parmeter ..... F16C 27/02 310/90
6,786,642 B2 * 9/2004 Dubreuil ..... F16C 17/024 384/106
6,837,621 B1 * 1/2005 Sakamoto ..... F04D 29/047 384/97
7,938,582 B2 * 5/2011 Barlerin ..... F16C 29/02 384/292

(Continued)

OTHER PUBLICATIONS

Foreign Communication from Related Application—International Search Report and Written Opinion of the International Searching Authority, International Application No. PCT/US2023/032915, dated Jan. 4, 2024. 9 pages.

*Primary Examiner* — Dominick L Plakkoottam
(74) *Attorney, Agent, or Firm* — Conley Rose, P.C.; Rodney B. Carroll

(57) ABSTRACT

A bearing assembly for an electrical motor of an ESP pump assembly comprising an outer bearing sleeve with an inner surface and an anti-rotation device rotationally coupling the outer sleeve to a stator and an inner bearing sleeve with an outer surface and an anti-rotation device coupling the inner bearing sleeve to a drive shaft. A fluid film gap located between the outer surface and the inner surface generates a high pressure zone and a low pressure zone in response to a rotational motion of the inner bearing sleeve relative to the outer bearing sleeve. The high pressure zone generates a fluid exit zone and the low pressure zone generates a fluid inlet zone for the working volume of fluid within the fluid film gap. A fluid supply path with ports at the sides of the bearing can exchange a volume of cooling fluid with the volume of working fluid within the fluid film.

20 Claims, 8 Drawing Sheets

(56) References Cited

U.S. PATENT DOCUMENTS

| | | | | |
|---|---|---|---|---|
| 8,616,863 | B2 * | 12/2013 | Forsberg | F04D 29/047 417/424.2 |
| 9,127,683 | B2 * | 9/2015 | Knapp | F04D 29/0473 |
| 9,506,471 | B2 * | 11/2016 | Eslinger | F04D 7/04 |
| 2002/0125777 | A1 * | 9/2002 | Parmeter | H02K 5/1672 310/90 |
| 2005/0269885 | A1 * | 12/2005 | Knox | F04D 29/061 310/90 |
| 2012/0224985 | A1 * | 9/2012 | Forsberg | F16C 17/18 29/898 |
| 2012/0251362 | A1 | 10/2012 | Forsberg | |
| 2014/0127052 | A1 | 5/2014 | Knapp | |
| 2017/0264161 | A1 * | 9/2017 | Forsberg | H02K 7/08 |
| 2019/0186245 | A1 * | 6/2019 | Bellmyer | F04D 29/588 |
| 2020/0067378 | A1 * | 2/2020 | Clingman | E21B 43/128 |
| 2021/0238969 | A1 * | 8/2021 | Perisho | H02K 1/28 |
| 2022/0090603 | A1 * | 3/2022 | Forsberg | F04D 13/086 |

* cited by examiner

JOURNAL BEARING LUBRICATION SIDE PORTS FOR OPTIMUM BEARING LOAD CAPACITY

CROSS-REFERENCE TO RELATED APPLICATIONS

None.

STATEMENT REGARDING FEDERALLY SPONSORED RESEARCH OR DEVELOPMENT

Not applicable.

REFERENCE TO A MICROFICHE APPENDIX

Not applicable.

BACKGROUND

Hydrocarbons, such as oil and gas, are produced from subterranean reservoir formations that may be located onshore or offshore. The construction processes involved in producing or removing these hydrocarbons typically involve a number of construction stages or steps such as drilling a wellbore at a desired wellsite, treating the wellbore to optimize production of hydrocarbons, completing the wellbore with completion equipment, and installing production equipment at the wellsite. Various production operations may be utilized to produce the hydrocarbons including pumping the hydrocarbons to the surface of the earth.

When performing production operations, pump systems, for example, electric submersible pump (ESP) systems, may be utilized when reservoir pressure alone is insufficient to produce hydrocarbons from a well or is insufficient to produce the hydrocarbons at a desirable rate from the well. A common type of ESP system comprises a centrifugal pump suspended on a string of production tubing within a wellbore. The pump is driven by a downhole electrical motor, normally a three-phase AC type. A power cable extends from a controller with a power source at the surface to the electrical motor to supply power to the downhole electrical motor.

BRIEF DESCRIPTION OF THE DRAWINGS

For a more complete understanding of the present disclosure, reference is now made to the following brief description, taken in connection with the accompanying drawings and detailed description, wherein like reference numerals represent like parts.

DETAILED DESCRIPTION

Figure 1:
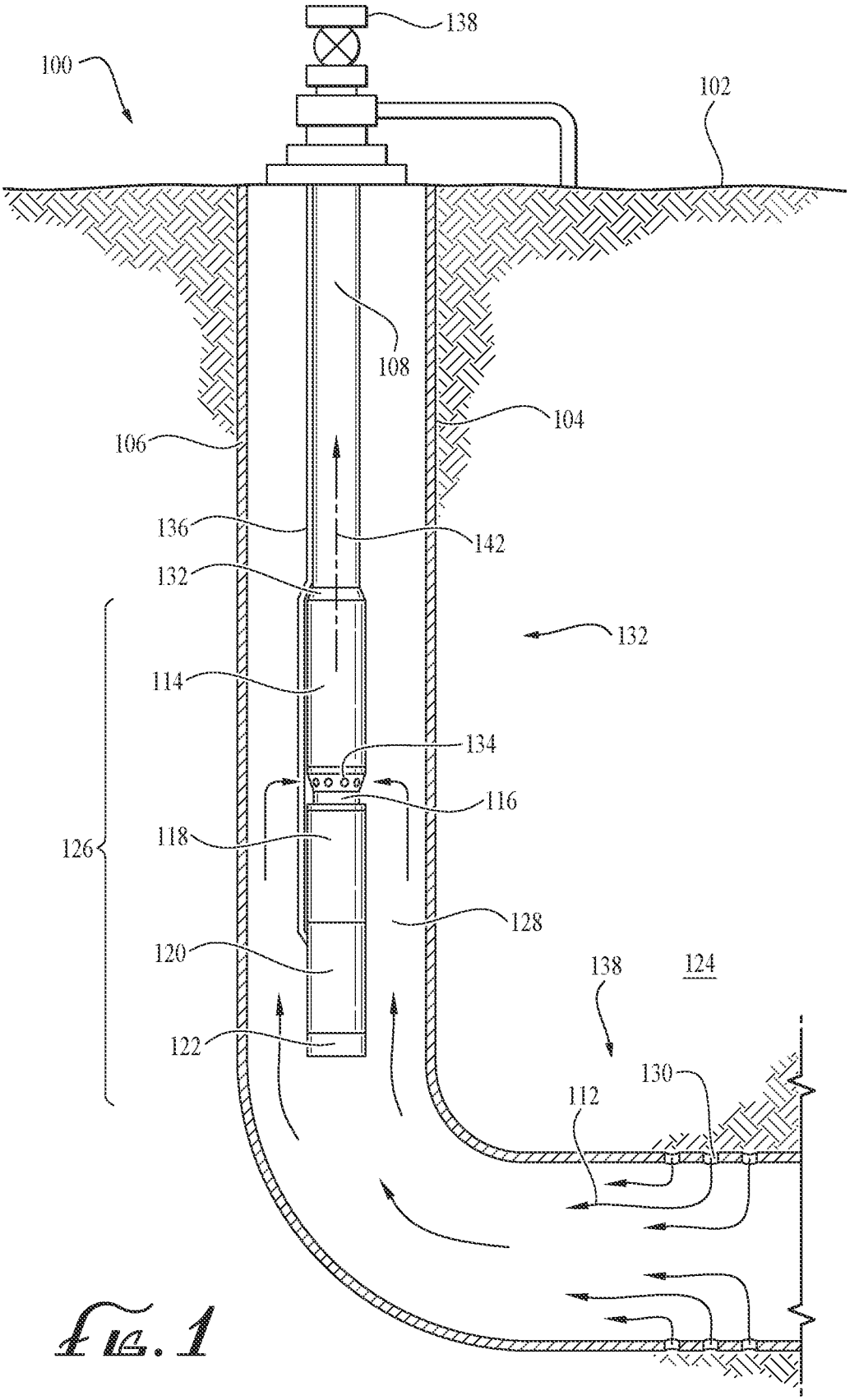
FIG. 1 is an illustration of an electric submersible pump (ESP) assembly in a wellsite environment according to an embodiment of the disclosure.

It should be understood at the outset that although illustrative implementations of one or more embodiments are illustrated below, the disclosed systems and methods may be implemented using any number of techniques, whether currently known or not yet in existence. The disclosure should in no way be limited to the illustrative implementations, drawings, and techniques illustrated below, but may be modified within the scope of the appended claims along with their full scope of equivalents.

As used herein, orientation terms "uphole," "downhole," "up," and "down" are defined relative to the location of the earth's surface relative to the subterranean formation. "Down" and "downhole" are directed opposite of or away from the earth's surface, towards the subterranean formation. "Up" and "uphole" are directed in the direction of the earth's surface, away from the subterranean formation or a source of well fluid. "Fluidically coupled" means that two or more components have communicating internal passageways through which fluid, if present, can flow. A first component and a second component may be "fluidically coupled" via a third component located between the first component and the second component if the first component has internal passageway(s) that communicates with internal passageway(s) of the third component, and if the same internal passageway(s) of the third component communicates with internal passageway(s) of the second component.

Hydrocarbons, such as oil and gas, are produced or obtained from subterranean reservoir formations that may be located onshore or offshore. The development of subterranean operations and the processes involved in removing hydrocarbons from a subterranean formation typically involve a number of construction steps such as drilling a wellbore at a desired well site, isolating the wellbore with a barrier material, completing the wellbore with various production equipment, treating the wellbore to optimize production of hydrocarbons, and providing surface production equipment for the recovery of hydrocarbons from the wellhead.

During production operations, artificial lift systems, for example, electric submersible pump (ESP) systems, may be used when reservoir pressure alone is insufficient to produce hydrocarbons from a well or is insufficient to produce the hydrocarbons at a desirable rate from the well. An ESP system is typically transported to the wellsite in sections assembled, attached to the production tubing, and conveyed into the wellbore by the production tubing to a target depth. The typical ESP system is configured with the pump section coupled to the production tubing with the motor section downhole or below the pump section. A power cable is typically mounted or strapped along the outside of the production tubing to provide electrical power to the electric motor of the ESP system.

The typical electric motor of the ESP system utilizes journal type bearings to prevent rotational wear and to centralize the rotors within the stator. An example of a journal type bearing is illustrated FIG. 6A-C, with a drive shaft 612 illustrated within a journal type bearing 610, also referred to as fluid film bearing. Although the drive shaft 612 is illustrated as a solid drive shaft, it is understood that the drive shaft 612 can comprise an internal bearing, a bearing surface, or some combination thereof. The longitudinal axis, also referred to as the central axis 624, of the drive shaft 612 can be eccentric, located at a distance "e", from the longitudinal axis of the bearing 610. The eccentricity can be a result of a force, called side loading. Side loading of the drive shaft 612 can be a combination of gravity, magnetic forces, and an unbalanced force in response to a shifted center of mass from the central axis 624. Gravity can cause a portion of the eccentricity by the weight of the drive shaft assembly, e.g., drive shaft and rotators, shifting the central axis 624 of the drive shaft assembly away from the longitudinal axis 622 of the bearing 610. For example, when the ESP system is oriented horizontally, the weight of the drive shaft assembly can cause the drive shaft 612 to be eccentric to the bearing 610. A second type of side load can be generated by the attraction of the permanent magnets of the rotors coupled to the drive shaft towards the stator. A third type of side load can be generated by rotation of a shifted center of mass of the drive shaft assembly. The center of mass of the drive shaft assembly may not be coincident with the central axis 624 in response to the manufacturing process (e.g., comprising the combination of individual shifted center of masses of each of the rotators sub components along with the various mounting hardware required to couple the rotors to the drive shaft). In some configurations, one type of side loading can be the dominate force, also referred to as the primary side loading force. For example, gravity can be the primary side loading force in a deviated wellbore or in a horizontal configuration of the ESP system. In another scenario, magnetism can be the primary side loading force in an ESP system with permanent magnet rotators when the ESP system is installed or suspended vertically with no deviation from a vertical orientation. The unbalanced force in response to the location of the center of mass of the drive shaft assembly can generate the primary side loading force when the ESP system is installed or suspended vertically with no deviation from a vertical orientation.

The volume between the drive shaft 612 and the bearing 610 can be filled with a volume of cooling and lubricating fluid. The lubricating fluid can be circulated (natural convection or forced circulation) through an internal passageway with the drive shaft 612. A fluid port 620 can extend from the internal passageway of the journal bearings 610 to dispense the lubricating fluid. A minimum gap between the inner surface 614 of the journal bearing 610 and the outer surface 616 of the drive shaft 612 can be the minimum film gap "R". The load capacity of the bearing system can be determined by the ability to maintain a minimum film gap "R" during operation to prevent contact of the bearing and drive shaft. The size of the film gap "R" can be a function of the fluid, the rotational speed of the drive shaft 612, the operating temperature, and the applied side load. The lubricating fluid can be selected based on the fluid properties, e.g., fluid viscosity, at operating temperatures.

Figure 6C:
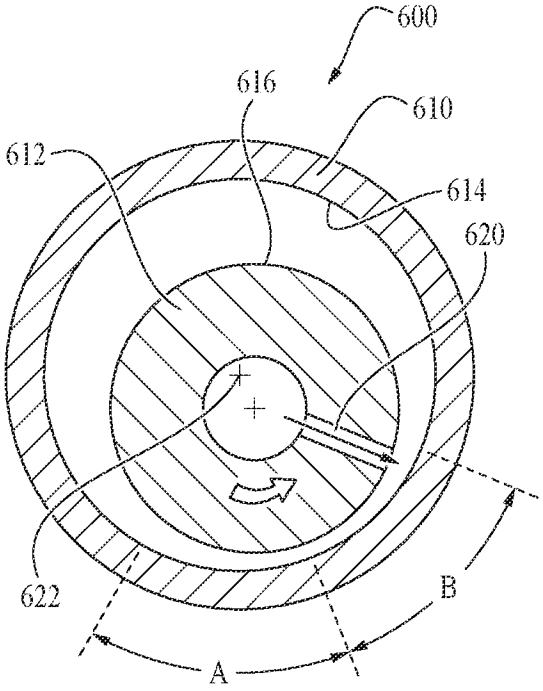
FIG. 6A-C are cross-sectional views of a drive shaft with a journal type bearing according to an embodiment of the disclosure.
Figure 6B:
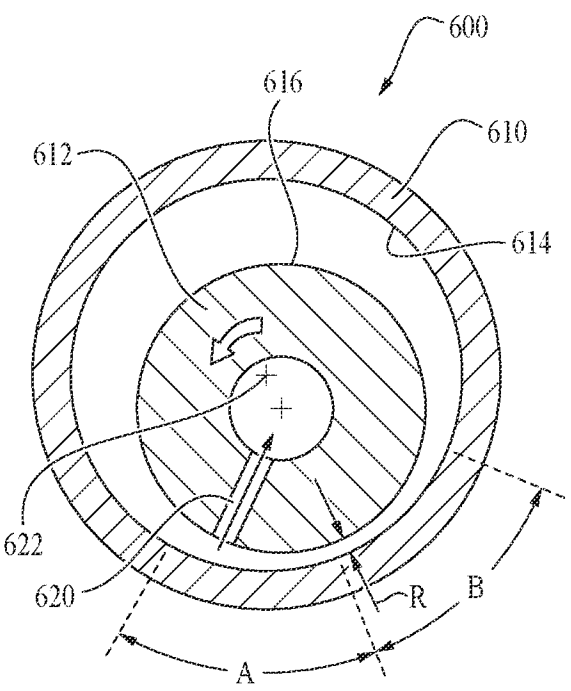
Figure 6A:
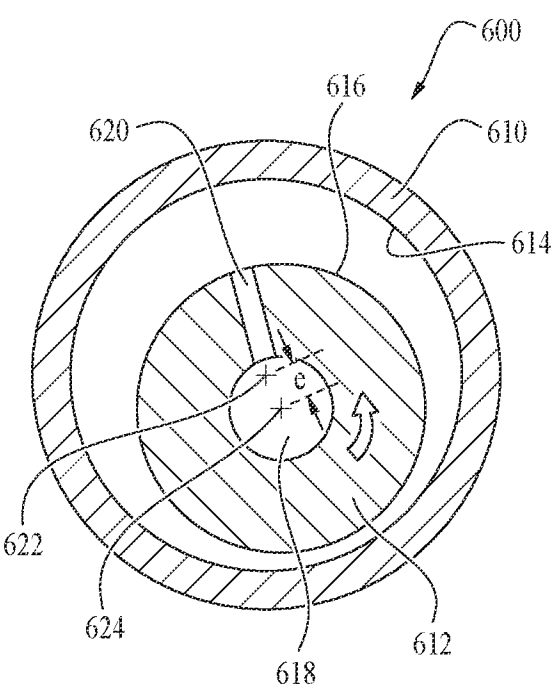

The volume of fluid within the journal bearings can passively transfer the lubricating fluid from the passage 618. The volume of fluid within the journal bearings 610 can generate a first pressure zone A and a second pressure zone B. The first pressure zone A can be generated by a combination of the eccentricity "e", the volume of fluid (e.g., working fluid), the fluid viscosity (choice of oil grade and operating temperature), and the rotational motion "w" of the drive shaft 612. The eccentricity "e" combined with the fluid friction from the rotational motion "w" can create a first pressure zone by the reduction in volume between the inner surface 614 of the journal bearing 610 and the outer surface 616 of the drive shaft 612 ahead of the minimum film gap "R". Conversely, a second pressure zone B can be created by the fluid passing through the minimum film gap "R" to the increase in volume between the inner surface 614 of the journal bearing 610 and the outer surface 616 of the shaft after the minimum film gap "R". As shown in FIG. 6A, fluid may remain static as the fluid port 620 is opposite of the film gap "R". As shown in FIG. 6B, the fluid may enter the fluid port 620 as the fluid port 620 passes through the first pressure zone A. The volume of fluid within the film gap "R" between the journal bearing 610 and drive shaft 612 may decrease as fluid enters the fluid port 620 from the first pressure zone A. As shown in FIG. 6C, the fluid may exit the fluid port 620 as the fluid port 620 passes through the second pressure zone B. A volume of fluid may exit the fluid port 620 as the fluid port enters the second pressure zone B. The exit of a volume of fluid in response to the port passing the first pressure zone A can reduce the maximum positive pressure and thus the load capacity of the bearing and introduce vibrational loading. The entrance of a volume of fluid in response to the port passing the second pressure zone B can increase (or restore) the load capacity of the bearing and induce vibrational loading. It is desirable to optimize the design of the bearing to reduce the loss of load capacity and avoid the vibrational loading.

One solution to optimizing the design of the journal bearing is to provide a journal bearing system. In an embodiment, the journal bearing system can comprise an inner bearing sleeve and an outer bearing sleeve. The inner bearing sleeve can be coupled to the drive shaft. The outer bearing sleeve can be coupled to the housing, the stator, or both. The surface area of the journal bearing system can be increased as the outer surface of the inner bearing sleeve is greater than the outer surface of the drive shaft that the inner bearing sleeve is mounted on. The increased surface area can increase the bearing capacity. The journal bearing system can be made from the same material (e.g., ceramic or high strength steel) that allows both bearings to expand and contract at the same rate. The journal bearing system can maintain the fluid film gap between the inner bearing sleeve and the outer bearing sleeve as the materials expand and contract. The materials of the journal bearing system can be different from the materials utilized for the ESP system, for example, the drive shaft.

Figure 7:
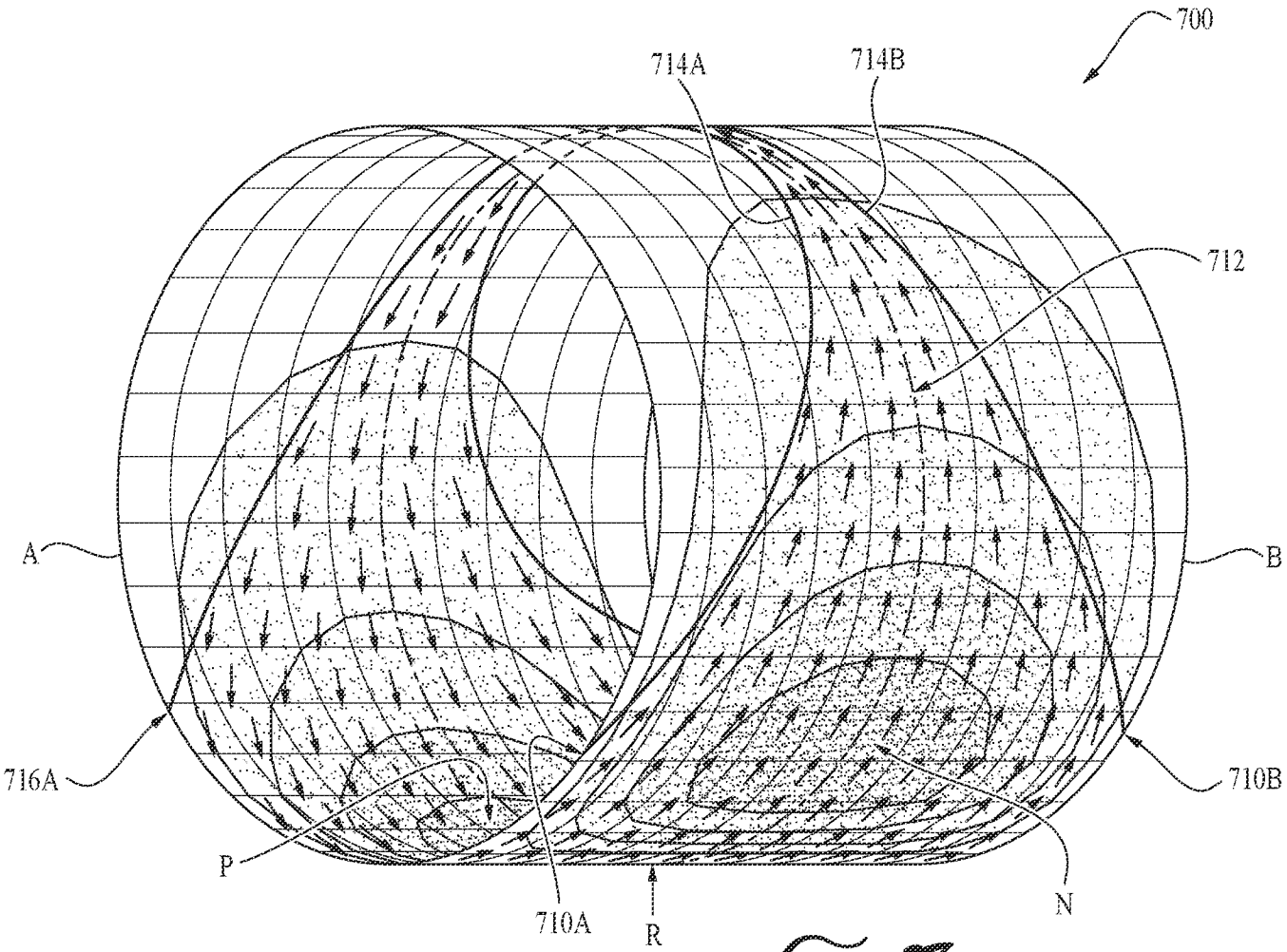
FIG. 7 is an illustration of fluid flow within a bearing assembly according to an embodiment of the disclosure.

Another solution to optimizing the design of the journal bearing system is to remove all features from the inside of the journal bearings. For example, eliminating the fluid port 620 (as shown in FIG. 6A), can prevent the removal of fluid from the film gap and increase the load capacity of the bearing system. In an embodiment, the journal bearing system has no features within the bearing surfaces (e.g., inner surface facing the outer surface) of the inner bearing sleeve and outer bearing sleeve. Turning now to FIG. 7, the inner bearing coupled to the drive shaft can be eccentric a distance "e" (as shown in FIG. 6A) to the outer bearing coupled to the housing and/or stator. The eccentricity "e" can be generated by any one of the side loads previously described, for example, configuring the electric motor in a deviated position, a transitional position, or a horizontal position. The combination of rotation of the inner bearing, the volume of working fluid, and the eccentricity "e" can create a positive pressure zone P and a negative pressure zone N. The positive pressure zone P can be a region of high pressure fluid located before the minimum film gap "R". The negative pressure zone N can be a region of low pressure fluid located after the minimum film gap "R". A fluid inlet 710 can form proximate to the negative pressure zone N as fluid enters or is drawn into the film gap between the bearings. The fluid inlet 710 can form on opposite sides of the bearing (i.e., near side "A" and far side "B") as indicated by fluid inlet 710A (near side "A") and 710B (far side "B"). The fluid can flow from the fluid inlet 710, along a flow line 714, to a fluid outlet 716. The fluid inlet 710, the flow lines 714, and the fluid outlet 716 can be considered symmetrical about the center line of the film gap between the bearings, as represented by a symmetry line 712, and thus the fluid inlet 710A, the fluid supply path 714A, and the fluid outlet 716A can have an equal and opposite twin on the opposite side of the symmetry line 712. The fluid supply path 714A and 714B follow an arc shape path as the gap between the inner bearing and outer bearing increases to a maximum gap opposite of the minimum gap, e.g., the film gap R. The arc shape path of the flow lines 714 can increase from the maximum gap to the fluid outlet 716 proximate the positive pressure zone P. The fluid outlet 716A and 716B (not shown) can be bounded by the inner surface of the outer bearing, the outer surface of the inner bearing, and the positive pressure zone P.

While optimization of the journal bearing system is advantageous in ESP systems operating in nominal environments, it is increasingly important in higher temperature environments. For example, where ceramic materials are utilized in the inner and outer bearing for higher temperature environments. The ceramic bearings are more tolerant of high temperatures and provides good bearing performance. Eliminating the fluid port 620 (as shown in FIG. 6A), can remove stress concentrations from the cross-sectional area of the bearing, improving ceramic bearing robustness. In moderate temperature environments, metal bearings may be used rather than the more expensive ceramic bearings.

Turning now to FIG. 1, a wellsite environment 100 is illustrated. In some embodiments, wellsite environment 100 comprises a wellbore 104 extending from a surface 102 to a permeable formation 124. The wellbore 104 can be drilled from surface 102 using any suitable drilling technique. The wellbore 104 can include a substantially vertical portion that transitions to a deviated portion 132 and into a substantially horizontal portion 138. In some embodiments, the wellbore 104 may comprise a nonconventional, horizontal, deviated, multilateral, or any other type of wellbore. Wellbore 104 may be defined in part by a casing string 106 that may extend from a surface 102 to a selected downhole location. Portions of wellbore 104 that do not comprise the casing string 106 may be referred to as open hole. While wellsite environment 100 illustrates a land-based subterranean environment, the present disclosure contemplates any wellsite environment including a subsea environment. In one or more embodiments, any one or more components or elements may be used with subterranean operations equipment located on offshore platforms, drill ships, semi-submersibles, drilling barges, and land-based rigs.

In some embodiments, various types of hydrocarbons or fluids 112 may be pumped from wellbore 104 to the surface 102 via the production tubing 108 using an electric submersible pump (ESP) assembly 126 disposed or positioned downhole, for example, within, partially within, or outside casing string 106 of wellbore 104. The ESP assembly 126 can be located within the deviated portion 132, a horizontal portion 138, or combination thereof, e.g., a transitional portion. The ESP assembly 126 may comprise various assemblies or sub-assemblies referred to as sections including a pump section 114, an intake section 116, a seal section 118, a motor section 120, and a sensor package 122. In some embodiments, the pump section 114 may comprise one or more centrifugal pump stages, each centrifugal pump stage comprising an impeller mechanically coupled to a drive shaft and a corresponding diffuser held stationary by and retained within the centrifugal pump assembly (e.g., retained by a housing of the centrifugal pump assembly). In some embodiments, the pump section 114 may not contain a centrifugal pump but instead may comprise a rod pump, a piston pump, a progressive cavity pump, or any other suitable pump system or combination thereof.

In some embodiments, a deviated portion 132 of the wellbore 104 can tilt or angle away from a true vertical centerline by at least 10 degrees. The deviated portion of the wellbore can be 10 to 45 degrees from vertical. The transitional portion of the wellbore can be from 45 degrees to 80 degrees from vertical. The horizontal portion of the wellbore can be from 80 degrees to 90 degrees from vertical.

The pump section 114 may transfer pressure to the production fluid 112 or any other type of downhole fluid to pump or lift the fluid 112 from the downhole reservoir to the surface 102 at a desired or selected pumping rate. In one or more embodiments, fluid 112 may enter the wellbore 104, casing string 106 or both through one or more perforations 130 in the permeable formation 124 and flow uphole to the intake section 116 of the ESP assembly 126. In some embodiments, the intake section 116 includes at least one port or inlet 134 for the production fluid 112 within the wellbore 104 to enter into the ESP assembly 126. The intake section 116 can be fluidically connected to the annulus 128 for the transfer of production fluids 112 to the pump section 114. In some embodiments, the intake section 116 can be configured to intake a production fluid 112 with a mix of liquid and gas, separate the liquid portion, expel the gaseous portion, and transfer the liquid portion to the pump section 114. The centrifugal pump stages within the pump section 114 may transfer pressure to the fluid 112 by adding kinetic energy to the fluid 112 via centrifugal force and converting the kinetic energy to potential energy in the form of pressure. In one or more embodiments, pump section 114 lifts the fluid 112 to the surface 102. In some embodiments, the fluid 112 may be referred to as reservoir fluid.

In some embodiments, a motor section 120 can include a drive shaft and an electric motor. In some embodiments, an electric cable 136 can be coupled to the electric motor of the motor section 120 and to a controller at the surface 102. The electric cable 136 can provide power and communication to the electric motor, transmit one or more control or operation instructions from controller to the electric motor, or both. In some embodiments, the electric motor may be a two pole, three phase squirrel cage induction motor, a permanent magnet motor (PMM), a hybrid PMM (induction and PMM combined) or any other electric motor operable or configurable to provide rotational power.

In some embodiments, the rotational power of the motor section 120 can be transferred from the motor section 120 to the pump section 114 via a drive shaft. A drive shaft within the motor section 120 can rotationally couple to a drive shaft within the seal section 118. The drive shaft within the seal section 118 can rotationally couple to a drive shaft within the intake section 116. The drive shaft within the intake section can rotationally couple to the drive shaft within the pump section 114. The rotational power of the motor section 120 can be transferred to the pump section 114 via a plurality of drive shafts rotationally coupled together.

Figure 2:
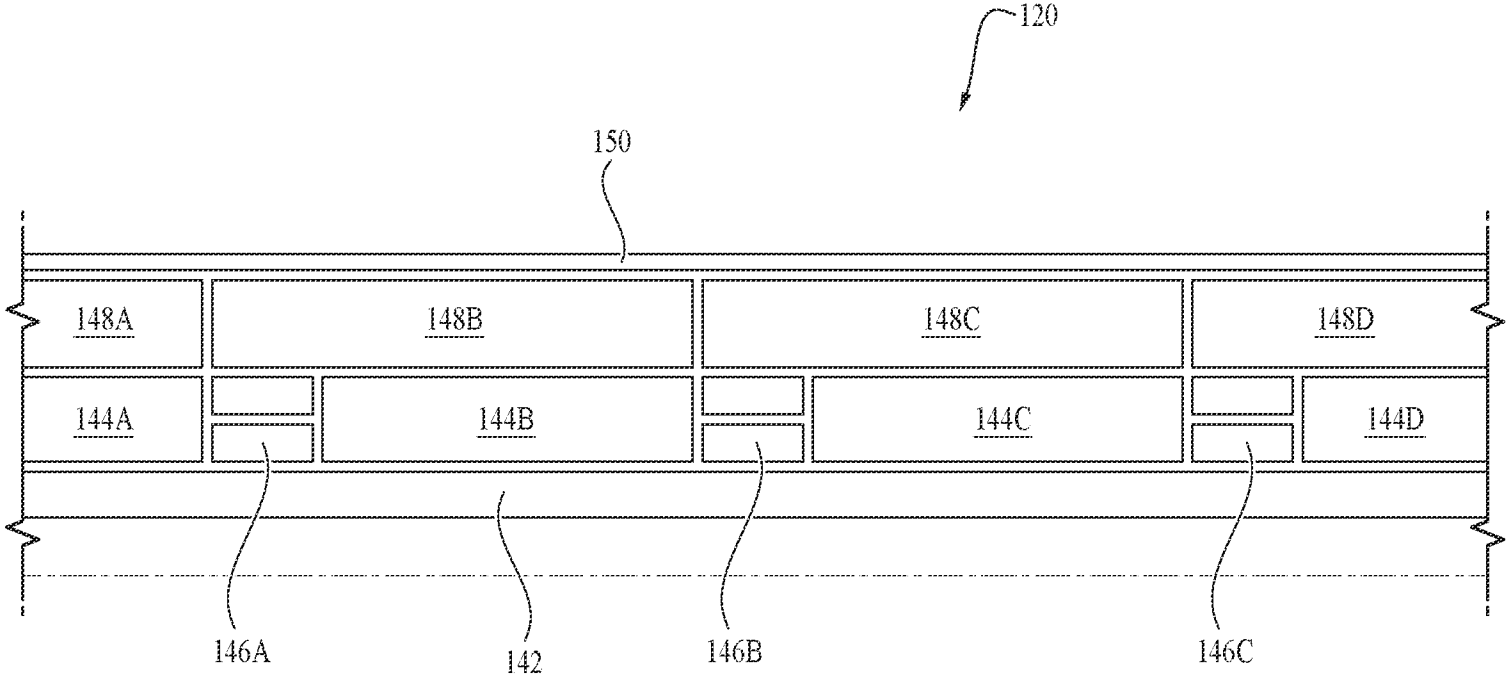
FIG. 2 is a partial cross-sectional view of a portion of the motor section according to an embodiment of the disclosure.

Turning now to FIG. 2, a portion of a motor section 120 is described. In some embodiments, the motor section 120 can comprise a drive shaft 142, a rotor 144, a bearing assembly 146, a stator 148, and a housing 150. The rotor 144 and a portion of the bearing assembly 146 can be mechanically coupled to the drive shaft 142. In some embodiments, the rotor 144 and drive shaft 142 can be a unitary construction. The stator 148 can be mechanically coupled to the housing 150. A portion of the bearing assembly 146 can be mechanically coupled to the stator 148, the housing 150, or both. Although the motor section 120 is illustrated with four rotors 144A-D, it is understood that the motor section can comprise 1, 2, 3, 4, 5, 6, 7, 8, 9, 10, or any number of rotors 144. Although the motor section 120 is illustrated with three bearing assemblies 146A-C, it is understood that the motor section 120 can comprise 1, 2, 3, 4, 5, 6, 7, 8, 9, 10, or any number of bearing assemblies 146. Although the motor section 120 is illustrated with four stators 148A-D, it is understood that the motor section 120 can comprise 1, 2, 3, 4, 5, 6, 7, 8, 9, 10, or any number of stators 148. Although the motor section 120 is illustrated with four rotors 144 and four stators 148, the motor section 120 can comprise an unequal number of rotors 144 and stators 148. For example, the motor section can comprise one rotor 144 with four stators 148A-D. In some context, two or more stators 148A-D can be referred to as stator modules and the compete assembly of stator modules can be referred to as a stator 148.

In some embodiments, the motor section 120 can comprise two or more drive shafts 142 mechanically coupled together. For example, the first rotor 144A can be coupled to a first drive shaft 142A, the second rotor 144B can be coupled to a second drive shaft 142B, the third rotor 144C can be coupled to a third drive shaft 142C, and the fourth rotor 144D can be coupled to a fourth drive shaft 142D. The first drive shaft 142A can be coupled to the second drive shaft 142B, and the second drive shaft 142B can be coupled to the third drive shaft 142C. In some embodiments, the motor section 120 may comprise two or more electric motors coupled together.

In some embodiments, each rotor 144 comprises a core and an induction squirrel cage that comprises conductors parallel to the center axis of the drive shaft 142, a first end ring electrically connected to a first set of ends of the conductors, and a second end ring electrically connected to a second set of ends of the conductors. A motor within the motor section 120 with these types of rotors 144 may be referred to as a conventional induction electric motor.

In some embodiments, each rotor 144 comprises a core and permanent magnet elements. The core may be formed from a plurality of metal laminations defining apertures to receive the conductors or the permanent magnet elements. The laminations may be made of magnetic metal. The laminations may be coated with an insulating material to reduce eddy currents between laminations of the rotor core. In an embodiment, the rotor core may be a solid core of magnetic metal. A motor within the motor section 120 with these types of rotors 144 may be referred to as a PMM electric motor.

In an embodiment, each rotor 154 may be a hybrid rotor and may comprise a core, an induction squirrel cage, and permanent magnet elements. A motor within the motor section 120 with these types of rotors 144 may be referred to as a hybrid PMM electric motor.

In some embodiments, a bearing assembly 146 can be placed between the plurality of rotors 144. For example, the bearing assembly 146A can be located between rotor 144A an rotor 144B. A portion of the bearing assembly 146 can be coupled to the drive shaft 142. A portion of the bearing assembly 146 can be supported by the housing 150, the stator 148, or combinations thereof. For example, a portion of the bearing assembly 146 can be supported by the stator 148 that is coupled to the housing 150, by a portion of a stator assembly (e.g., a part of a stator assembly), or a portion of a housing assembly (e.g., a part of a housing assembly). The bearing assemblies 146 support and stabilize the drive shaft 142 and maintain a clearance gap between the outside of the rotor 144 and the inside of the stator 152. The bearing assemblies 146 each comprise an inner bearing sleeve and an outer bearing sleeve with a fluid path as will be described further hereinafter.

Figure 3:
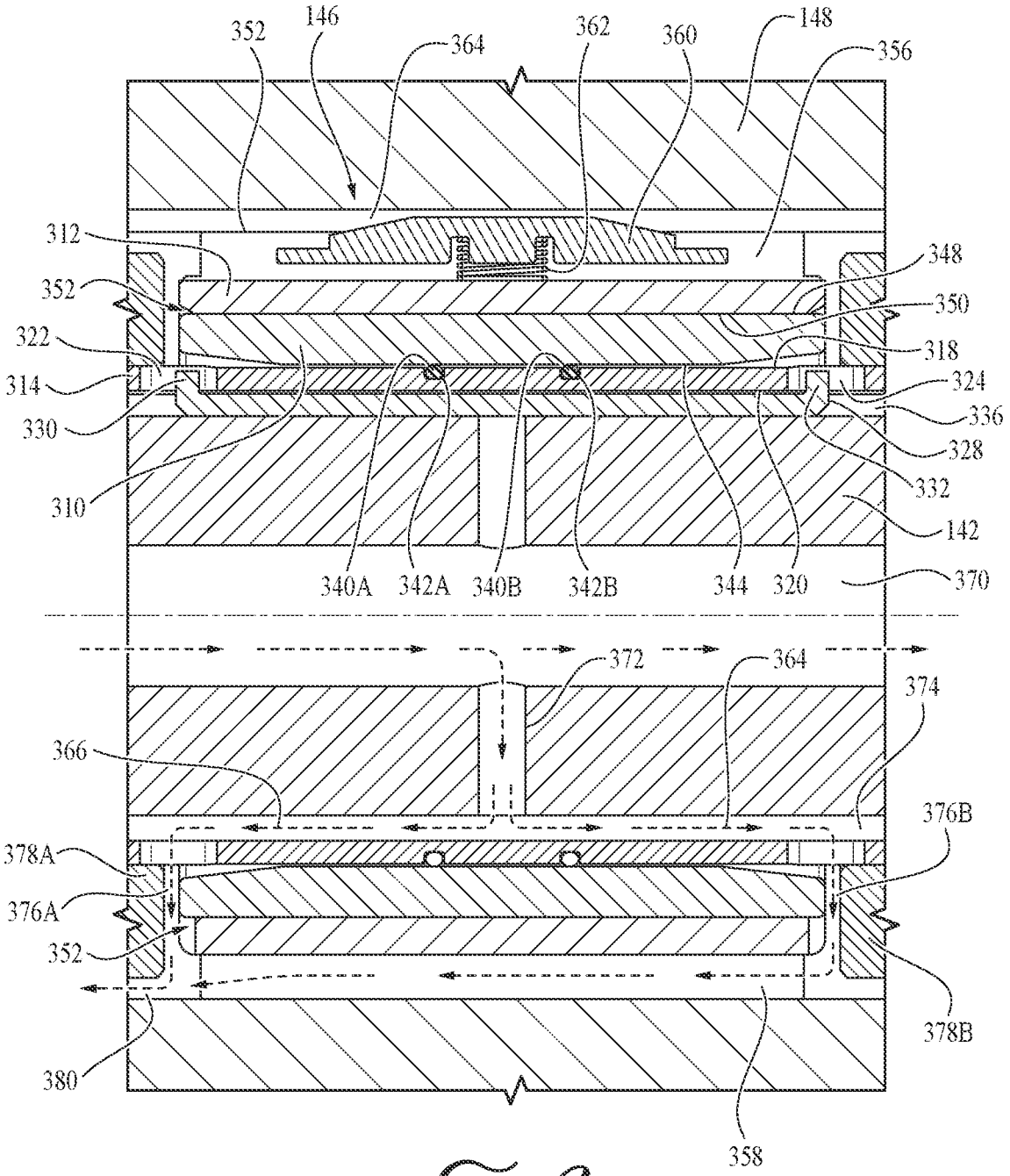
FIG. 3 is a partial cross-sectional view of a bearing assembly according to an embodiment of the disclosure.

Turning now to FIG. 3, a bearing assembly is described. The bearing assembly 146 comprises an inner bearing sleeve 310, an outer bearing sleeve 312, and first anti-rotation device comprising a bearing support sleeve 314. The bearing support sleeve 314 can be a generally cylinder shape with an outer surface 318, an inner surface 320, a front port 322, and a back port 324. The front port 322 and back port 324 can be configured to receive a portion of an inner key 328. The inner key 328 can be a rectangular bar shape with a front tab 330 located within the front port 322 and a back tab 332 located within the back port 324. The rectangular bar shape of the inner key 328 can fit within a shaft keyway 336 located on the outer surface of the drive shaft 142. The shaft keyway 336 can rotationally couple the drive shaft 142 to the bearing support sleeve 314 via the inner key 328. The bearing support sleeve 314 can include a front anti-rotation ring 340A within a circumferential groove 342A and a back anti-rotational ring 340B within a circumferential groove 342B. The anti-rotation rings 340 can extend from the bottom of the circumferential groove 342 to the inner surface 344 of the inner bearing sleeve 310 and can be configured to rotationally couple the bearing support sleeve 314 to the inner bearing sleeve 310. The anti-rotation rings 340 can be a deformable metal formed in a torus shape that grips the circumferential groove 342 in the bearing support sleeve 314 and the inner surface 344 of the inner bearing sleeve 310. The inner bearing sleeve 310 can be a generally cylindrical shape with an inner surface 344 and an outer surface 348. The inner bearing sleeve 310 can be rotationally coupled to the drive shaft 142 via the anti-rotation rings 340 of the bearing support sleeve 314.

The outer bearing sleeve 312 can be rotationally coupled to the stator 148 by a second anti-rotation device. The term coupled to the stator can comprise the stator 148, a portion of the stator 148, the housing 150, a portion of the housing, or combinations thereof. It is understood that coupling the outer bearing sleeve 312 to the stator 148 can comprise any combination of the stator 148 and housing 150. The outer bearing sleeve 312 can be generally cylindrical in shape with an outer surface 353 and the inner surface 350. The outer surface 353 can include a key slot 356 and a return flow slot 358. The second anti-rotation device can comprise a locking key 360. The locking key 360 and activation spring 362 can be installed in the key slot 356. The activation spring 362 can bias the locking key 360 to engage a keyway 365 in the stator 148. The outer bearing sleeve 312 can be rotationally coupled to the stator 148 by the locking key 360. The outer surface 348 of the inner bearing sleeve 310 can be separated from the inner surface 350 of the outer bearing sleeve 312 by the film gap 352.

The fluid for the film gap can be supplied by a first fluid supply path 364 and a second fluid supply path 366. The first fluid supply path 364 can comprise a path along the drive shaft 142, a radial path beside the bearing assembly 146, and a return path parallel to the stator 148. The path along the drive shaft 142 can include an inner bore 370, a fluid port 372, and a flow slot 374. The drive shaft 142 can be a cylinder shape with an inner bore 370. A set of fluid ports 372 can be located proximate to the bearing assembly 146. Although two fluid ports 372 are illustrated, it is understood that there may be 1, 2, 3, 4, 5, 6, 7, 8, or any number of fluid ports 372. Although two fluid ports 372 are illustrated within the same radial plane, it is understood that 2, 3, 4, 5, or any number of sets of fluid ports 372 could be spaced axially as well. Although two fluid supply paths 364, 366 and a return path are illustrated, it is understood that the motor section 120 can comprise any number of fluid supply paths with the return path. It is understood that the return path may join or include the return path of addition fluid supply paths. The fluid port 372 can extend from the outer surface to the inner bore 370 of the drive shaft 142 and intersect a flow slot 374 on the outer surface of the drive shaft 142. In some embodiments, the flow slot 374 can be a second shaft keyway (e.g., shaft keyway 336B) mirrored from the first shaft keyway 336 or rotated about the longitudinal axis of the drive shaft 142 to a second radial location. The front port 322 and back port 324 of the bearing support sleeve 314 can align with, or intersect, the flow slot 374 on the drive shaft 142. The first fluid supply path 364 can include a radial gap 376B between the bearing assembly 146 and a back end stop 378B. The back end stop 378 can be a generally cylinder shape with an inner surface coupled to the bearing support sleeve 314, the shaft 142, rotor module (not shown), or combinations thereof. The first fluid supply path 364 can include a return flow slot 358 located on the outer surface of the outer bearing sleeve 312.

The first fluid supply path 364 can include a portion of the volume of fluid within the inner bore 370 of the drive shaft 142, a portion of the fluid flowing into the fluid port 372, that portion of fluid can transfer along the flow slot 374 to the port 324, and through the port 324 and into the radial gap 376B. The volume of fluid flow through the radial gap 376B can mix with the fluid within the film gap 352, thus supplying fresh cool fluid to the film gap. The film gap 352 between the inner bearing sleeve 310 and the outer bearing sleeve 312 can be an embodiment of the film gap 700 of FIG. 7. Referring back to FIG. 7, the fluid within the radial gap 376B can enter the film gap 352 proximate to a fluid inlet 710B, follow the fluid supply path 714B and exit proximate to a fluid outlet 716B. The volume of fluid flow through the radial gap 376B can follow the return flow slot 358 of the outer bearing sleeve 312 to a return path 380 to return to a fluid reservoir.

The second fluid supply path 366 can include a portion of the volume of fluid within the inner bore 370 of the drive shaft 142, a portion of the fluid flowing into the fluid port 372, that portion of fluid can transfer along the flow slot 374 to the front port 322, and through the front port 322 and into the gap 376A. The volume of fluid flow through the gap 376A can mix with the fluid within the film gap 352, thus supplying fresh cool fluid to the film gap. As previously described, the film gap 352 can be an embodiment of the film gap 700 of FIG. 7, and the fluid within the gap 376A can enter the film gap 352 proximate to a fluid inlet 710A, follow the fluid supply path 714A and exit proximate to a fluid outlet 716A. The volume of fluid flowing through the gap 376A can enter the return path 380 to return to a fluid reservoir.

The volume of fluid within the first fluid supply path 364 and the second fluid supply path 366 can be provided by natural convection, self-pumping action, or a fluid supply pump. In some embodiments, the flow of fluid within the fluid supply path 364, 366 can be provided by natural convection wherein the hotter fluid within the return path 380 is replaced by cooler fluid within the inner bore 370. In some embodiments, the flow of fluid within the fluid supply path can be generated by a self-pumping action of the rotator assembly and/or the fluid port 372. In some embodiments, the rotor assembly can generate a self-pumping action by a centrifugal force imparted on the cooling fluid by the rotation of the rotator assembly/drive shaft. Likewise, the centrifugal force imparted on the fluid within each of the fluid ports 372 can act as a pump to transfer the fluid from the inner bore 370 into the fluid supply path. In some embodiments, the fluid flow within the inner bore 370 can be provided by an oil supply pump. The oil supply pump can be driven by the electric motor within the motor section 120 or by a second motor.

Figure 4:
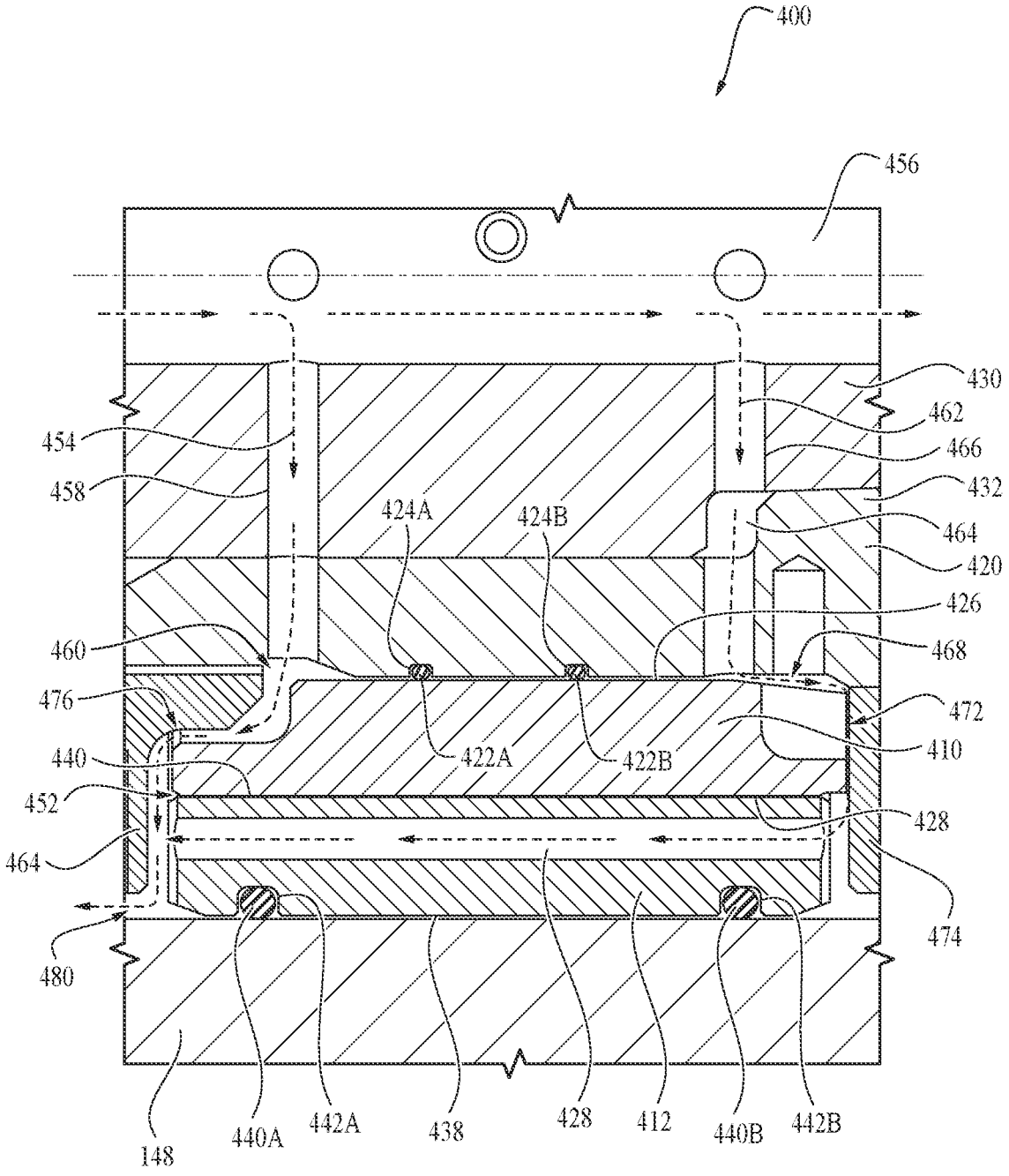
FIG. 4 is a partial cross-sectional view of another bearing assembly according to an embodiment of the disclosure.

Turning now to FIG. 4, a bearing assembly is described. The bearing assembly 400 comprises an inner bearing sleeve 410 and an outer bearing sleeve 412. The drive shaft 420 can be a generally cylindrical shape that includes a first anti-rotation device comprising a front anti-rotation ring 422A within a circumferential groove 424A and a back anti-rotational ring 422B within a circumferential groove 424B. The anti-rotation rings 422 can extend from the bottom of the circumferential groove 424 to the inner surface 426 of the inner bearing sleeve 410 and can be configured to rotationally couple the drive shaft 420 to the inner bearing sleeve 410. The anti-rotation rings 422 can be a deformable metal formed in a torus shape that grips the circumferential groove 424 in the drive shaft 420 and the inner surface 426 of the inner bearing sleeve 410. The inner bearing sleeve 410 can be a generally cylindrical shape with an outer surface 428 and an inner surface 426. The inner bearing sleeve 410 can be rotationally coupled to the drive shaft 420 via a first anti-rotation device, e.g., the anti-rotation ring 422. In some embodiments, the drive shaft 420 comprises a first drive shaft 430 and a second drive shaft 432 mechanically and rotationally coupled together.

The outer bearing sleeve 412 can be rotationally coupled to the stator 148 by a second anti-rotation device. The second anti-rotation device can rotationally couple the outer bearing sleeve 412 to the stator 148, the housing 150, or combinations thereof. As previously described, coupling the outer bearing sleeve 412 to the stator 148 can comprise any combination of the stator 148 and housing 150. The outer bearing sleeve 412 can be generally cylindrical in shape with an outer surface 438 and the inner surface 440. The second anti-rotation device can comprise anti-rotation rings. The outer surface 438 can include anti-rotation rings 440A-B within a circumferential groove 442A-B. The anti-rotation rings 440A-B can extend from the bottom of the circumferential grooves 442A-B to the bottom surface of the stator 148. The outer bearing sleeve 412 can be rotationally coupled to the stator 148 by the anti-rotation rings 440A-B. The outer surface 428 of the inner bearing sleeve 410 can be separated from the inner surface 440 of the outer bearing sleeve 412 by a film gap 452.

The fluid for the film gap 452 can be supplied by a first fluid supply path 454 and a second fluid supply path 462. The first fluid supply path 454 can comprise a path extending from the drive shaft 420, a radial path beside the bearing assembly 400, and a return path parallel to the stator 148. The path extending from the drive shaft 420 can include an inner bore 456, a first fluid port 458, and a first groove 460. The first fluid port 458 can extend through drive shaft 420 or can extend through the first drive shaft 430 and the second drive shaft 432. The first groove 460 can be located on the outer surface of the drive shaft 420 and configured to transition the fluid flow to the radial gap 476 between the front end stop 464 and the inner bearing sleeve 410. The front end stop 464 can be a generally cylinder shape with an inner surface coupled to the drive shaft 420. The volume of fluid flow through the radial gap 476 can mix with the fluid within the film gap 452, thus supplying fresh cool fluid to the film gap. The film gap 452 between the inner bearing sleeve 410 and the outer bearing sleeve 412 can be an embodiment of the film gap 700 of FIG. 7. Referring back to FIG. 7, the fluid within the radial gap 476 can enter the film gap 452 proximate to a fluid inlet 710B, follow the fluid supply path 714B, and exit proximate to a fluid outlet 716B. The volume of fluid flow through the radial gap 476 can follow a return path 480 to return to a fluid reservoir.

The second fluid supply path 462 can include a portion of the volume of fluid within the inner bore 456 of the drive shaft 420, a second fluid port 466, and a second groove 468. The second fluid port 466 can extend through drive shaft 420 or can extend through the first drive shaft 430 and the second drive shaft 432. The second groove 468 can be located on the outer surface of the drive shaft 420 and configured to transition the fluid flow to the radial gap 472 between the back end stop 474 and the inner bearing sleeve 410. The back end stop 474 can be a generally cylinder shape with an inner surface coupled to the drive shaft 420. The volume of fluid flow through the radial gap 472 can mix with the fluid within the film gap 452, thus supplying fresh cool fluid to the film gap. The film gap 452 between the inner bearing sleeve 410 and the outer bearing sleeve 412 can be an embodiment of the film gap 700 of FIG. 7. Referring back to FIG. 7, the fluid within the radial gap 472 can enter the film gap 452 proximate to a fluid inlet 710A, follow the fluid supply path 714A, and exit proximate to a fluid outlet 716A. The volume of fluid flow through the radial gap 472 can follow a return bore 478 within the outer bearing sleeve 412 to a return path 480 and return to a fluid reservoir.

Figure 5:
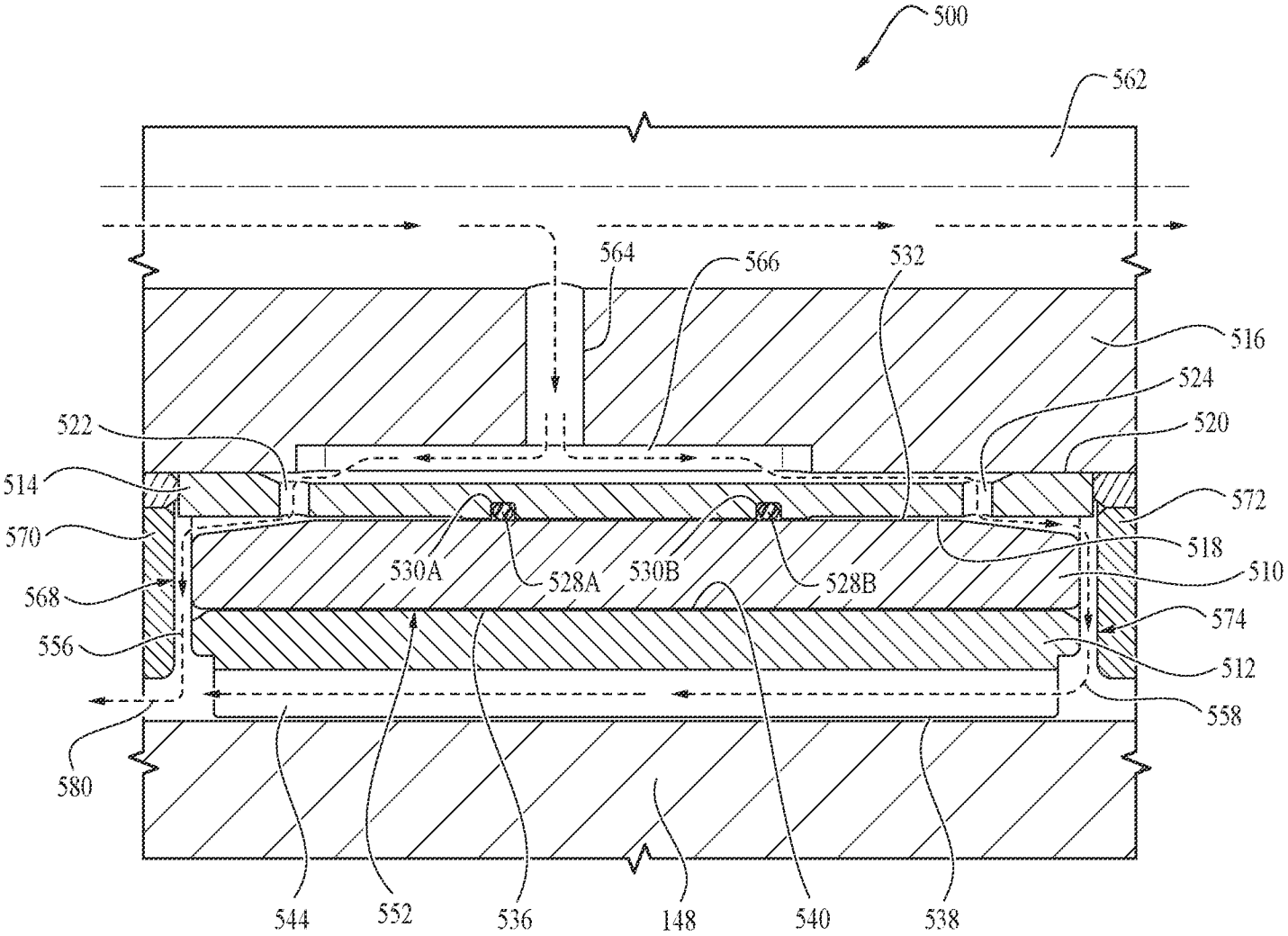
FIG. 5 is a partial cross-sectional view of still another bearing assembly according to an embodiment of the disclosure.

Turning now to FIG. 5, a bearing assembly is described. The bearing assembly 500 comprises an inner bearing sleeve 510, an outer bearing sleeve 512, and bearing support sleeve 514. The bearing support sleeve 514 can be a generally cylinder shape with an outer surface 518, an inner surface 520, a front port 522, and a back port 524. The front port 522 and back port 524 can be configured to receive a portion of an inner key (not shown). The bearing support sleeve 514 and inner key can have a similar configuration as the bearing support sleeve 314 and inner key 328 of FIG. 3. The inner key can be a rectangular bar shape with a front tab configured to locate within the front port 522 and a back tab configured to locate within the back port 524. The rectangular bar shape of the inner key can fit within a shaft keyway (not shown) located on the outer surface of the drive shaft 516. The shaft keyway can rotationally couple the drive shaft 516 to the bearing support sleeve 514 via the inner key. The bearing support sleeve 514 can include a front anti-rotation ring 528A within a circumferential groove 530A and a back anti-rotational ring 528B within a circumferential groove 530B. The anti-rotation rings 528 can extend from the bottom of the circumferential groove 530 to the inner surface 532 of the inner bearing sleeve 510 and can be configured to rotationally couple the bearing support sleeve 514 to the inner bearing sleeve 510. The inner bearing sleeve 510 can be a generally cylindrical shape with an outer surface 536 and an inner surface 532. The inner bearing sleeve 510 can be rotationally coupled to the drive shaft 516 via the anti-rotation rings 528 of the bearing support sleeve 514 and the inner key.

The outer bearing sleeve 512 can be rotationally coupled to the stator 148, the housing 150, or combinations thereof. As previously described, coupling the outer bearing sleeve 512 to the stator 148 can comprise any combination of the stator 148 and housing 150. The outer bearing sleeve 512 can be generally cylindrical in shape with an outer surface 538 and the inner surface 540. The outer surface 538 can include a key slot (not shown) and a return flow slot 544. A locking key and activation spring (similar to locking key 360 and activation spring 362 of FIG. 3) can be installed in the key slot. The activation spring can bias the locking key to engage a keyway (not shown) in the stator 148. The outer bearing sleeve 512 can be rotationally coupled to the stator 148 by the locking key. The outer surface 536 of the inner bearing sleeve 510 can be separated from the inner surface 540 of the outer bearing sleeve 512 by a film gap 552.

Figure 8:
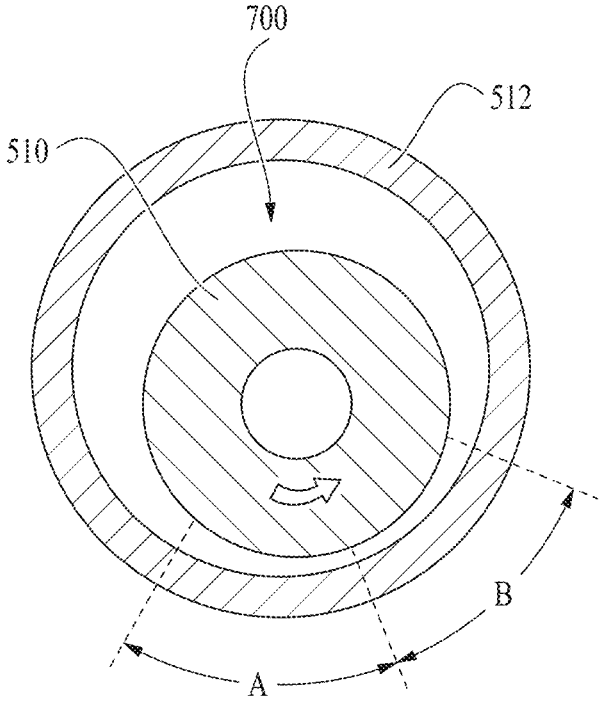
FIG. 8 is a schematic cross-sectional view of a film gap between the inner bearing sleeve and the outer bearing sleeve.

The fluid for the film gap 552 can be supplied by a first fluid supply path 556 and a second fluid supply path 558. The first fluid supply path 556 can comprise a path extending from the drive shaft 516, a radial path beside the bearing assembly 500, and a return path parallel to the stator 148. The path extending from the drive shaft 516 can include an inner bore 562, a fluid port 564, and a fluid feed groove 566. The fluid port 564 can extend through drive shaft 516 from an inner surface to the fluid feed groove 566. The fluid feed groove 566 can be located on the outer surface of the drive shaft 516 and configured to transition the fluid flow to the radial gap 568 between the front end stop 570 and the inner bearing sleeve 510. The front end stop 570 can be a generally cylinder shape with an inner surface coupled to the drive shaft 516. The volume of fluid flow through the radial gap 568 can mix with the fluid within the film gap 552, thus supplying fresh cool fluid to the film gap. The film gap 552 between the inner bearing sleeve 510 and the outer bearing sleeve 512 can be an embodiment of the film gap 700 of FIG. 7 and FIG. 8. Referring back to FIG. 7, the fluid within the radial gap 568 can enter the film gap 552 proximate to an fluid inlet 710B, follow the fluid supply path 714B, and exit proximate to a fluid outlet 716B. The volume of fluid flow through the radial gap 568 can follow a return path 580 to return to a fluid reservoir.

The second fluid supply path 558 can include a portion of the volume of fluid within the inner bore 562 of the drive shaft 516, the fluid port 564, and a second portion of the fluid feed groove 566. The second portion of the fluid feed groove 566 can be located on the outer surface of the drive shaft 516 and configured to transition the fluid flow to the radial gap 574 between the back end stop 572 and the inner bearing sleeve 510. The back end stop 572 can be a generally cylinder shape with an inner surface coupled to the drive shaft 516. The volume of fluid flow through the radial gap 574 can mix with the fluid within the film gap 552, thus supplying fresh cool fluid to the film gap. The film gap 552 between the inner bearing sleeve 510 and the outer bearing sleeve 512 can be an embodiment of the film gap 700 of FIG. 7. Referring back to FIG. 7, the fluid within the radial gap 574 can enter the film gap 552 proximate to a fluid inlet 710A, follow the fluid supply path 714A, and exit proximate to a fluid outlet 716A. The volume of fluid flow through the radial gap 574 can follow a return flow slot 544 within the outer bearing sleeve 512 to a return path 580 and return to a fluid reservoir.

An ESP system using the bearing assembly can be utilized for producing wellbore fluids to the surface. In some embodiments, a method of lifting a production fluid in a wellbore to surface can be performed by operating an electric motor, as described above, having a bearing assembly, e.g., bearing assembly 146 of FIG. 3, bearing assembly 400 of FIG. 4, or bearing assembly 500 of FIG. 5. Transporting an ESP assembly, e.g., ESP assembly 126, to a remote wellsite. The ESP assembly comprises a pump section, e.g., pump section 114, a seal section, e.g., seal section 118, and a motor section, e.g., motor section 120. The electric motor comprises a drive shaft, at least one bearing assembly, a rotor, a stator, and a housing. The bearing assembly comprises an inner bearing sleeve, a film gap, and an outer bearing sleeve. The inner bearing sleeve is rotationally coupled to the drive shaft via anti-rotation rings. The outer bearing sleeve is rotationally coupled to the stator via anti-rotation rings. The drive shaft of the electric motor is coupled to a drive shaft of the seal section and the drive shaft of the seal section is coupled to a drive shaft of the pump section.

Coupling the ESP assembly to a production tubing, e.g., production tubing 108. Electrically coupling the motor section of the ESP assembly to a controller via an electric cable 136. Conveying the ESP assembly into the wellbore 104 via the production tubing.

Providing electric power to the electric motor of the motor section of the ESP assembly via the power cable. Lifting production fluid by the ESP assembly while located in a downhole environment having a temperature in the range from 25 degrees Celsius to 100 degrees Celsius, from 100 degrees Celsius to 150 degrees Celsius, from 150 degrees Celsius to 200 degrees Celsius, or from 200 degrees Celsius to 280 degrees Celsius.

Lifting production fluid by the ESP assembly while located in a downhole environment having a temperature in the range from 280 degrees Celsius to 350 degrees Celsius. In an embodiment, the lifting of production fluids by the ESP assembly while located in a downhole environment can include a temperature range of 280 degrees Celsius to 400 degrees Celsius, a range of 280 degrees Celsius to 450 degrees Celsius, a range of 280 degrees Celsius to 500 degrees Celsius, or a range of 280 degrees Celsius to 550 degrees Celsius. In an embodiment, a high temperature limitation for operation of the ESP assembly may be established not by the bearing assembly but instead by other components in the electric motor such as the dielectric oil in the electric motor.

The downhole environment may have a high temperature continuously or the temperature may reach into the high temperature range under certain infrequent but notwithstanding predictable circumstances. For example, in a SAGD downhole environment, temperature may remain in a first temperature range during normal operations, but when steam undesirably breaks into the main production wellbore (e.g., passes from the steam bearing wellbore parallel into the production wellbore), the downhole temperature may enter into a second higher temperature range. While steam breaking into the main production wellbore (e.g., into wellbore 104 of FIG. 1) may be infrequent, it can be expected to happen from time to time, and it may be desirable under this eventuality that the electric motor within the motor section 120 be able to survive and operate in this circumstance. In a geothermal production environment, the downhole temperature may remain continuously in a high temperature range.

In some embodiments, the method further comprises providing a volume of cooling fluid within a reservoir located on the ESP assembly. The fluid supply path can transfer a volume of cooling fluid to the radial gap between the end ring and the bearing assembly. The working fluid within the fluid film gap 352 can generate a positive pressure zone and a low pressure zone. The positive pressure zone can generate a fluid outlet zone to move or transfer a portion of the working fluid within the fluid film gap 352 to the fluid supply path with the cooling fluid. The low pressure zone can generate a fluid inlet zone to move or transfer cooling fluid into the fluid film gap 352 from the fluid supply path. The exchange of cooling fluid from the fluid supply path with the working fluid within the fluid film gap can be referred to as a transfer of fluid or an exchange of fluid. The portion of the working fluid exchanged with the cooling fluid can return to the reservoir of cooling fluid via a return fluid flow path.

While the description of the method above has been articulated with reference to an electric motor, it will be appreciated that that method is easily adapted to a method of lifting production fluid in a wellbore by operating a seal section of an ESP assembly having bearings mounted using anti-rotation devices, by operating a gas separator of an ESP assembly having bearings mounted using anti-rotation devices, by operating a pump assembly having bearings mounted anti-rotation devices, and/or by operating an electric motor having bearings mounted using anti-rotation devices.

In some embodiments, the ESP assembly 126 can be reconfigured for use at the surface. For example, the ESP assembly 125 can be reconfigured as a production pump assembly located at surface 102. For example, the ESP assembly 126 can be reconfigured as a horizontal surface pump assembly configured to pump fluid from the production tubing 108 or into the production tubing 108 via a wellhead. The horizontal surface pump assembly can be fluidically connected to the production tubing 108 via a wellhead. The horizontal surface pump assembly can be located at surface 102 and configured to pump fluid, e.g., salt water, from a volume, e.g., pipeline or storage tank, into the production tubing 108 via the wellhead. In another scenario, the horizontal surface pump assembly can transfer, also referred to as boosting, fluid 112 from the production tubing 108 to another surface facility. The horizontal surface pump configuration (e.g., reconfiguration of the ESP assembly 126) may comprise at least one pump section 114, an intake section 116, a seal section 118 (also called a thrust chamber), and motor section 123. Although the horizontal surface pump configuration may have a different appearance than the downhole configuration of the ESP assembly 126, it is understood that the general description and function of the sections are the same. The horizontal surface pump reconfiguration of ESP assembly 126 may be mounted on a skid or installed within a surface facility.

ADDITIONAL DISCLOSURE

The following are non-limiting, specific embodiments in accordance and with the present disclosure:

A first embodiment, which is a bearing assembly for an electrical motor of an ESP Pump Assembly, comprising an inner bearing sleeve generally cylindrical with an outer surface and an inner surface, wherein a first anti-rotation device rotationally couples the inner bearing sleeve to a drive shaft; an outer bearing sleeve generally cylindrical with an outer surface and an inner surface, wherein a second anti-rotation device rotationally couples the outer bearing sleeve to a stator; a fluid film gap located between the outer surface of the inner bearing sleeve and the inner surface of the outer bearing sleeve, wherein the fluid film gap is located between a positive pressure zone and a low pressure zone in response to a rotational motion of the inner bearing sleeve relative to the outer bearing sleeve, wherein a fluid exit zone is located proximate to the positive pressure zone, wherein a fluid inlet zone is located proximate to the low pressure zone, and wherein a working volume of fluid is located within the fluid film gap; and a fluid supply path configured to exchange a volume of cooling fluid with the working volume of fluid within the fluid film gap.

A second embodiment, which is the bearing assembly of the first embodiment, wherein the first anti-rotation device comprises at least one anti-rotation in a circumferential groove on the outer surface of the drive shaft engaged with an inner surface of an inner bearing sleeve.

A third embodiment, which is the bearing assembly of any of the first and the second embodiments, wherein the second anti-rotation device comprises a key engaged with a keyway on the inner surface of the stator, and wherein a bias spring urges the key within a key slot on the outer surface of the outer bearing sleeve into engagement with the keyway.

A fourth embodiment, which is the bearing assembly of any of the first through the third embodiments, wherein the second anti-rotation device comprises at least one anti-rotation in a circumferential groove on the outer surface of the outer bearing sleeve engaged with an inner surface of the stator.

A fifth embodiment, which is the bearing assembly of the first through the fourth embodiments, wherein the first anti-rotation device comprises a bearing support sleeve, an inner key, and at least one anti-rotation in a circumferential groove on the outer surface of the bearing support sleeve engaged with an inner surface of an inner bearing sleeve, wherein the at least one anti-rotation is configured to rotationally couple the bearing support sleeve to the inner bearing sleeve, wherein the inner key is configured to rotationally couple the bearing support sleeve to the drive shaft with a shaft keyway on the outer surface of the drive shaft extending into at least one port on the bearing support sleeve.

A sixth embodiment, which is the bearing assembly of any of the first through the fifth embodiments, wherein the fluid supply path includes a first fluid supply path and a second fluid supply path; wherein the first fluid supply path comprises an inner bore of the drive shaft, a fluid port on the drive shaft, a first radial gap between a stop and the bearing assembly, and a return flow path; and wherein the second fluid supply path comprises an inner bore of the drive shaft, a fluid port on the drive shaft, a second radial gap between a stop and the bearing assembly, a return flow slot, and a return flow path.

A seventh embodiment, which is the bearing assembly of any of the first through the sixth embodiment, wherein an axial centerline of the inner bearing sleeve and an axial center line of the outer bearing sleeve are eccentric in response to a side loading of the bearing assembly.

A eighth embodiment, which is the bearing assembly of any of the first through the seventh embodiments, wherein the side loading is a result of i) gravity, ii) magnetic forces, iii) an unbalanced force of the drive shaft, or combinations thereof.

A ninth embodiment, which is the bearing assembly of any of the first through the eighth embodiments, wherein the gravity side load is in response to the ESP Pump Assembly being located in a deviated wellbore, a transitional wellbore, or a horizontal wellbore.

A tenth embodiment, which is the bearing assembly of any of the first through the ninth embodiments, wherein the magnetic side load is in response to magnetic rotors being attracted to a stator within the electrical motor of the ESP Pump Assembly.

An eleventh embodiment, which is the bearing assembly of any of the first through the eighth embodiments, wherein the unbalanced force side load is in response to the center of mass of a drive shaft assembly being not coincident with a central axis of the drive shaft assembly.

A twelfth embodiment, which is the bearing assembly of any of the first through the eleventh embodiments, wherein the ESP Pump Assembly is fluidically coupled to a wellbore and operating at a surface location with a horizontal orientation.

A thirteenth embodiment, which a method of cooling a bearing assembly of an electric motor of an Electric Submersible Pump (ESP) assembly, comprising: conveying the ESP assembly into a wellbore via a production tubing; providing electric power to the electric motor via a power cable; generating a positive pressure zone and a low pressure zone within at least one bearing assembly within the electric motor; providing a volumetric flow of cooling fluid via a fluid supply path to the bearing assembly; exchanging a portion of a volume of working fluid via a fluid inlet proximate to the low pressure zone and a fluid exit proximate to the positive pressure zone; and lifting production fluids by the ESP assembly in response to providing electric power.

A fourteenth embodiment, which is the method of the thirteenth embodiment, wherein providing the volumetric flow comprises i) passive convection of the cooling fluid, ii) a self-pumping action, iii) a cooling fluid supply pump, or iv) combinations thereof.

A fifteenth embodiment, which is the method of any of the thirteenth through the fourteenth embodiment, wherein the bearing assembly comprises an inner bearing sleeve and an outer bearing sleeve, and wherein the positive pressure zone and the low pressure zone are generated by a rotation of the inner bearing sleeve relative to the outer bearing sleeve and an eccentricity value of a centerline of the inner bearing sleeve to a centerline of the outer bearing sleeve.

A sixteenth embodiment, which is the method of any of the thirteenth through the fifteenth embodiment, wherein the eccentricity value is in response to a side loading of the inner bearing sleeve, and wherein the side loading is caused by i) tilting the electrical motor at least 10 degrees, ii) magnetic forces of a rotor, iii) an unbalanced force, or iv) combinations thereof.

A seventeenth embodiment, which is the method of any of the thirteenth through the fifteenth embodiment, wherein the ESP Assembly comprises a motor section, a seal section, and a pump section.

A eighteenth embodiment, which is the method of any of the thirteenth through the fifteenth embodiment, further comprising: transporting an ESP assembly to a remote wellsite; coupling the ESP assembly to a production tubing; and electrically coupling an electric motor of the ESP assembly to a controller via a power cable.

A nineteenth embodiment, which is a system, comprising a reservoir of cooling fluid; a bearing assembly comprising an inner bearing sleeve and an outer bearing sleeve; a fluid supply path comprising an inner bore of a drive shaft, a fluid port within the drive shaft, a radial gap beside the bearing assembly, and a return flow path; wherein a fluid film located between an inner surface of the outer bearing sleeve and an outer surface of the inner bearing sleeve generates a positive pressure zone and a low pressure zone in response to a rotation of the drive shaft, a volume of working fluid, and a value of eccentricity; and wherein the fluid film of the bearing assembly is configured to: generating a fluid inlet approximate to the low pressure zone with the fluid film;

generating a fluid exit approximate to the positive pressure zone within the fluid film; exchanging a portion of a volume of working fluid, via the fluid inlet and the fluid exit, with a portion of a volume of cooling fluid supplied from the reservoir by the fluid supply path; and returning the portion of the volume of working fluid to the reservoir of cooling fluid.

An twentieth embodiment, which is the system of the nineteenth embodiment, further comprising an electric motor comprising a drive shaft, at least one rotor, at least one stator, a bearing assembly, and a housing.

A twenty-first embodiment, which is the system of the nineteenth and twentieth embodiment, wherein the inner bearing sleeve is rotationally coupled to the drive shaft, and wherein the outer bearing sleeve is rotationally coupled to a stator.

A twenty-second embodiment which is the system of the nineteenth and twenty-first embodiment, wherein the fluid port within the drive shaft is aligned with the bearing assembly.

A twenty-third embodiment which is the system of the nineteenth and twenty-second embodiment, wherein the drive shaft of an electric motor is rotationally coupled to a drive shaft of a pump section.

A twenty-fourth embodiment which is the system of the nineteenth and twenty-third embodiment, wherein the value of eccentricity is a measurement of a displacement of an axial centerline of the inner bearing from an axial centerline of the outer bearing sleeve.

A twenty-fifth embodiment which is the system of the nineteenth and twenty-fourth embodiment, wherein the value of the eccentricity is in response to locating an electric motor within a wellbore with an angle of at least 10 degrees from true vertical.

While embodiments have been shown and described, modifications thereof can be made by one skilled in the art without departing from the spirit and teachings of this disclosure. The embodiments described herein are exemplary only, and are not intended to be limiting. Many variations and modifications of the embodiments disclosed herein are possible and are within the scope of this disclosure. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, Rl, and an upper limit, Ru, is disclosed, any number falling within the range is specifically disclosed. In particular, the following numbers within the range are specifically disclosed: R=Rl+k*(Ru−Rl), wherein k is a variable ranging from 1 percent to 100 percent with a 1 percent increment, i.e., k is 1 percent, 2 percent, 3 percent, 4 percent, 5 percent, . . . 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. Use of the term "optionally" with respect to any element of a claim is intended to mean that the subject element is required, or alternatively, is not required. Both alternatives are intended to be within the scope of the claim. Use of broader terms such as comprises, includes, having, etc. should be understood to provide support for narrower terms such as consisting of, consisting essentially of, comprised substantially of, etc.

Accordingly, the scope of protection is not limited by the description set out above but is only limited by the claims which follow, that scope including all equivalents of the subject matter of the claims. Each and every claim is incorporated into the specification as an embodiment of the present disclosure. Thus, the claims are a further description and are an addition to the embodiments of the present disclosure. The discussion of a reference herein is not an admission that it is prior art, especially any reference that may have a publication date after the priority date of this application. The disclosures of all patents, patent applications, and publications cited herein are hereby incorporated by reference, to the extent that they provide exemplary, procedural, or other details supplementary to those set forth herein.

What is claimed is:

1. A bearing assembly for an electrical motor of an electric submersible pump (ESP) assembly, comprising:

an inner bearing sleeve generally cylindrical with an outer surface and an inner surface, wherein a first anti-rotation device rotationally couples the inner bearing sleeve to a drive shaft;

an outer bearing sleeve generally cylindrical with an outer surface and an inner surface, wherein a second anti-rotation device rotationally couples the outer bearing sleeve to a stator;

a fluid film gap located between the outer surface of the inner bearing sleeve and the inner surface of the outer bearing sleeve, wherein a first pressure zone and a second pressure zone are generated in the fluid film gap in response to a rotational motion of the inner bearing sleeve relative to the outer bearing sleeve, wherein a working volume of fluid is located within the fluid film gap, and wherein a pressure of the working fluid in the first pressure zone is greater than a pressure of the working fluid in the second pressure zone; and a fluid supply path configured to exchange a volume of cooling fluid with the working volume of fluid within the fluid film gap.

2. The bearing assembly of claim 1, wherein the first anti-rotation device comprises at least one anti-rotation ring in a circumferential groove on an outer surface of the drive shaft engaged with an inner surface of an inner bearing sleeve.

3. The bearing assembly of claim 1, wherein the second anti-rotation device comprises a key engaged with a keyway on an inner surface of the stator, and wherein a bias spring urges the key within a key slot on the outer surface of the outer bearing sleeve into engagement with the keyway.

4. The bearing assembly of claim 1, wherein the second anti-rotation device comprises at least one anti-rotation ring in a circumferential groove on the outer surface of the outer bearing sleeve engaged with an inner surface of the stator.

5. The bearing assembly of claim 1, wherein the first anti-rotation device comprises a bearing support sleeve, an inner key, and at least one anti-rotation ring in a circumferential groove on an outer surface of the bearing support sleeve engaged with an inner surface of an inner bearing sleeve, wherein the at least one anti-rotation ring is configured to rotationally couple the bearing support sleeve to the inner bearing sleeve, wherein the inner key is configured to rotationally couple the bearing support sleeve to the drive shaft with a shaft keyway on an outer surface of the drive shaft extending into at least one port on the bearing support sleeve.

6. The bearing assembly of claim 1, wherein the fluid supply path includes a first fluid supply path and a second fluid supply path;

wherein the first fluid supply path comprises an inner bore of the drive shaft, a fluid port on the drive shaft, a first radial gap between a stop and the bearing assembly, and a return flow path; and wherein the second fluid supply path comprises the inner bore of the drive shaft, the fluid port on the drive shaft, a second radial gap between the stop and the bearing assembly, a return flow slot, and the return flow path.

7. The bearing assembly of claim 1, wherein:

an axial centerline of the inner bearing sleeve and an axial center line of the outer bearing sleeve are eccentric in response to a side loading of the bearing assembly.

8. The bearing assembly of claim 7, wherein:

the side loading is a result of i) gravity, ii) magnetic forces, iii) an unbalanced force of the drive shaft, or combinations thereof.

9. The bearing assembly of claim 8, wherein:

the side load resulting from gravity is in response to the ESP assembly being located in a deviated wellbore, a transitional wellbore, or a horizontal wellbore.

10. The bearing assembly of claim 8, wherein:

the side load resulting from magnetic forces is in response to magnetic rotors being attracted to a stator within the electrical motor of the ESP assembly.

11. The bearing assembly of claim 8, wherein:

the side load resulting from the unbalanced force is in response to a center of mass of a drive shaft assembly being not coincident with a central axis of the drive shaft assembly.

12. The bearing assembly of claim 1, wherein the ESP assembly is fluidically coupled to a wellbore and operates at a surface location with a horizontal orientation.

13. The bearing assembly of claim 1, further comprising: a third pressure zone at an end of the bearing assembly, wherein the first pressure zone has a higher pressure than the third pressure zone in response to rotation of the bearing assembly, and wherein the second pressure zone has a lower pressure than the third pressure zone in response to rotation of the bearing assembly; and the fluid supply path configured to supply the cooling fluid to the third pressure zone, wherein a volume of the cooling fluid is exchanged from the third pressure zone to the working volume of fluid within the fluid film gap, directed into the second pressure zone, and directed out of the first pressure zone.

14. A method of cooling a bearing assembly of an electric motor of an Electric Submersible Pump (ESP) assembly, comprising:

conveying the ESP assembly into a wellbore via a production tubing;

providing electric power to the electric motor via a power cable;

generating a first pressure zone and a second pressure zone in a fluid film gap located between an outer surface of an inner bearing sleeve of a bearing assembly of the electric motor and an inner surface of an outer bearing sleeve of the bearing assembly of the electric motor, wherein a pressure of working fluid in the first pressure zone is greater than a pressure of the working fluid in the second pressure zone;

providing a volumetric flow of cooling fluid via a fluid supply path to the bearing assembly; and lifting production fluids by the ESP assembly in response to providing electric power.

15. The method of claim 14, wherein providing the volumetric flow comprises i) passive convection of the cooling fluid, ii) a self-pumping action, iii) a cooling fluid supply pump, or iv) combinations thereof.

16. The method of claim 14, wherein the first pressure zone and the second pressure zone are generated by a rotation of the inner bearing sleeve relative to the outer bearing sleeve and an eccentricity of a centerline of the inner bearing sleeve with respect to a centerline of the outer bearing sleeve, and the ESP assembly comprises a seal section and a pump section.

17. The method of claim 14, further comprising:

transporting an ESP assembly to a remote wellsite;

coupling the ESP assembly to a production tubing; and electrically coupling the electric motor to a controller via a power cable.

18. A system, comprising:

a bearing assembly comprising an inner bearing sleeve and an outer bearing sleeve; and a fluid supply path comprising an inner bore of a drive shaft rotationally coupled to the inner bearing sleeve, a fluid port within the drive shaft, a radial gap beside the bearing assembly, and a return flow path;

wherein a first pressure zone and a second pressure zone are generated in a fluid gap located between an outer surface of the inner bearing sleeve and an inner surface of the outer bearing sleeve in response to a rotation of the inner bearing sleeve with respect to the outer bearing sleeve, and wherein a pressure of working fluid in the first pressure zone is greater than a pressure of the working fluid in the second pressure zone.

19. The system of claim 18, wherein the bearing assembly is part of an electric motor coupled to the drive shaft, and the electric motor is disposed within a wellbore and oriented at an angle of at least 10 degrees from true vertical.

20. The bearing assembly of claim 18, further comprising generating a third pressure zone at an end of the bearing assembly, wherein the first pressure zone has a higher pressure than the third pressure zone in response to rotation of the bearing assembly, wherein the second pressure zone has a lower pressure than the third pressure zone in response to rotation of the bearing assembly, wherein the fluid supply path supplies a cooling fluid to the third pressure zone, wherein a volume of the cooling fluid is exchanged from the third pressure zone to a working volume of fluid within the fluid film gap, directed into the second pressure zone, and directed out of the first pressure zone.

* * * * *